US008104507B2

(12) United States Patent
Chang et al.

(10) Patent No.: US 8,104,507 B2
(45) Date of Patent: Jan. 31, 2012

(54) GAS SWITCH CAPABLE OF ADJUSTING FIRE INTENSITY FINELY

(75) Inventors: Pao-Chi Chang, Shihgang Township, Taichung County (TW); Sen-Yu Wu, Feng-Chou Village (TW); Shu-Mei Liu, Shihgang Township, Taichung County (TW)

(73) Assignee: Seven Universe Industrial Co., Ltd., Taichung County (TW)

( * ) Notice: Subject to any disclaimer, the term of this patent is extended or adjusted under 35 U.S.C. 154(b) by 527 days.

(21) Appl. No.: 12/372,828

(22) Filed: Feb. 18, 2009

(65) Prior Publication Data

US 2010/0178623 A1 Jul. 15, 2010

(51) Int. Cl.
*F16K 5/00* (2006.01)

(52) U.S. Cl. ..... 137/599.17; 137/630.15

(58) Field of Classification Search ..... 137/599.16, 137/599.17, 601.05, 601.12, 601.15, 630.15, 137/630.16, 630.17, 630.2
See application file for complete search history.

(56) References Cited

U.S. PATENT DOCUMENTS

| | | | | |
|---|---|---|---|---|
| 2,963,042 | A * | 12/1960 | Dolby et al. | 137/628 |
| 3,292,660 | A * | 12/1966 | Zarybnicky | 137/599.17 |
| 3,398,890 | A * | 8/1968 | Fleer | 236/15 A |
| 5,027,854 | A * | 7/1991 | Genbauffe | 137/599.17 |
| 5,975,135 | A * | 11/1999 | Aguirre-Esponda et al. | 137/599.17 |
| 6,520,481 | B2 * | 2/2003 | Harneit | 251/207 |
| 6,726,175 | B1 * | 4/2004 | Saba et al. | 251/209 |
| 6,880,571 | B2 * | 4/2005 | Lin | 137/599.17 |

* cited by examiner

*Primary Examiner* — Craig Schneider
*Assistant Examiner* — Seth Faulb
(74) *Attorney, Agent, or Firm* — Ming Chow; Sinorica, LLC

(57) ABSTRACT

A gas switch capable of adjusting fire intensity finely includes a gas switch capable of adjusting fire intensity finely, comprising a switch body inside which a guide is installed, a valve set that revolves inside the switch body and includes a hollow valve and a pilot valve moving elastically through the valve, a drive component installed inside the switch body, which contains a rotating rod that can move along and rotate round the same shaft of the valve set, a guide rod placed on the rotating rod and leaning on the guide, a regulating block installed movably at one end of the rotating rod and leaning against the pilot valve, and a connecting component for linking the drive component with the valve set flexibly.

10 Claims, 6 Drawing Sheets

GAS SWITCH CAPABLE OF ADJUSTING FIRE INTENSITY FINELY

BACKGROUND OF THE INVENTION

1. Field of the Invention

The present invention relates generally to a gas switch, and more particularly to a gas switch that is capable of achieving smooth adjustment of fire in different intensity from strong fire to weak fire.

2. Description of the Related Art

Conventionally, the method used in a gas switch to adjust fire intensity is often achieved by using a drive rotating shaft to drive a fastener inside the switch body to rotate, so as to make air ports or guide slots in different diameter on the fastener correspond with air intake holes inside the switch body respectively. In such a way, the gas switch will generate different fire intensity as the drive rotating shaft revolves to release gas of different flows. Since usually there is space between the air ports or guide slots in different diameter, the cross section area for gas flows will not be evenly altered in the process of adjusting different air ports or guide slots to correspond with the air intake. As a result, it is impossible to achieve smooth and linear changes in the course of adjusting fire among different intensities, thus further making it impossible for users to finely adjust the fire intensity of gas stoves effectively.

To solve this problem, someone designed a kind of gas switches able to adjust fire intensity. On the fastener of such gas switch, only one guide slot and gas guide hole is installed and connected with the internal through hole, and the guide slot is joint with the gas intake hole. So, the slide guide component built on the drive shaft rod can work with the undulant guide to make the drive rotating shaft generate axial displacement as the shaft rotates, thus changing the space between one end of the fastener rod and the air outlet hole and further adjusting the cross-section area for gas flows. By doing so, it will achieve relatively smooth changes among fires of high, medium and low intensities.

While the aforesaid design of gas switches can lead to smooth changes of fire in different intensity, its slide guide component in the shape of a round rod can be built into the slot at one end of the fastener, in addition to working with the guide. Therefore, the drive rotating shaft can drive the fastener to rotate as it revolves. In another word, the slide guide component serves not only as a structure to control axial displacement of the drive shaft rod, but also as a component to rotate the fastener. However, the slide guide component is liable to wear and tear due to friction with walls of the fastener slot in the long period and effect of payloads generated in driving the fastener to rotate since it is a tiny component in the shape of a round rod. Moreover, in the cases where the slide guide component is worn out, control error will occur in the process of working with the guide to make the drive shaft rod generate axial displacement, which, in return, will lead to the result that fires in different intensities cannot be smoothly changed in a real way. Therefore, it is obvious that such gas switches still have defects in practical applications.

SUMMARY OF THE INVENTION

The primary objective of the present invention is to provide a gas switch capable of adjusting fire intensity finely, which can eliminate the above-mentioned shortcoming that slide guide components of gas switches are subject to wear and tear, and can really achieve smooth and linear changes of fires in different intensity, thus achieving better effect of fine adjustment of fire intensity.

According to the objective of the present invention, the present invention provides a gas switch capable of adjusting fire intensity finely, comprising a switch body which includes a base and a cover. In the base, there is a conical valve chamber with an opening at one end and a gas intake hole as well as a gas outlet hole connected through the valve chamber, while the cover is placed at the side opposite to the valve chamber of the base, and a guide is installed inside the cover; a valve set, which is installed and rotates inside the valve chamber and includes a hollow valve and a pilot valve. On the valve, there are several air ports and inside it, there is a control port. The pilot valve can move elastically inside the valve with one control structure installed at one end of it, which always closes the control port when the pilot valve is not pushed; a drive component installed on the cover, which contains a rotating rod that rotates round and moves along the same shaft of the valve set; a guide rod installed on the rotating rod and leans on the guide; a regulating block which can move along the rotating rod and is closely connected with the pilot valve; and a connecting component for linking the drive component with the valve set flexibly.

BRIEF DESCRIPTION OF THE DRAWINGS

In the following paragraphs, an example of the preferred embodiment of the present invention is given with reference to the accompanying drawings to further describe the present invention in detail as follows, wherein.

DETAILED DESCRIPTION OF THE INVENTION

Figure 1:
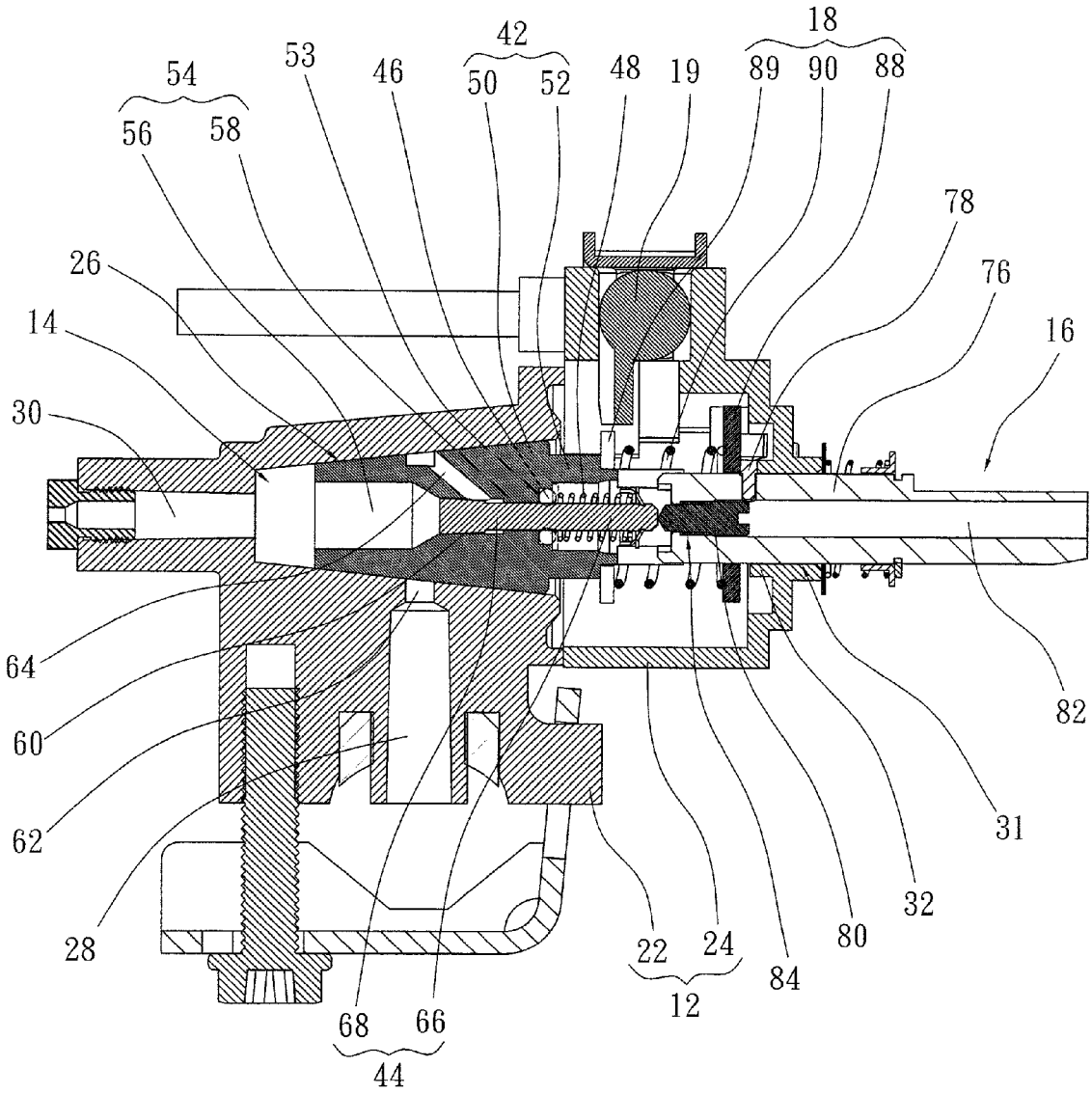
FIG. 1 is a schematic view of a first preferred embodiment of the present invention.
Figure 3:
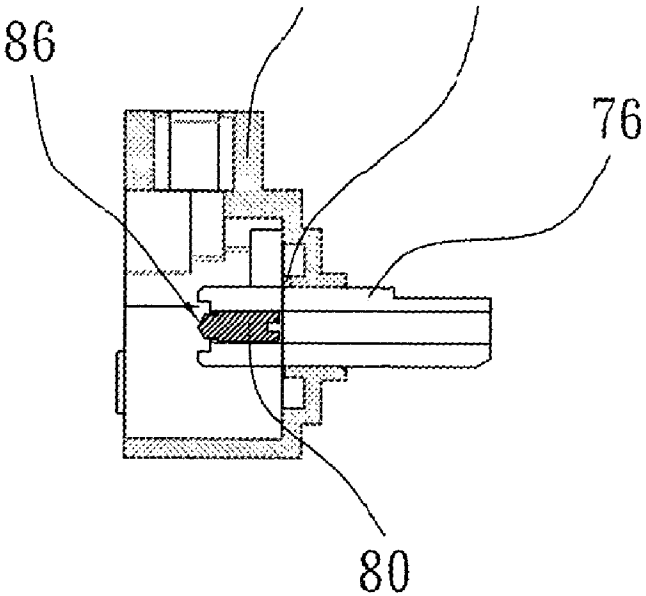
FIG. 3 is a sectional view along the 3-3 line of FIG. 2.
Figure 2:
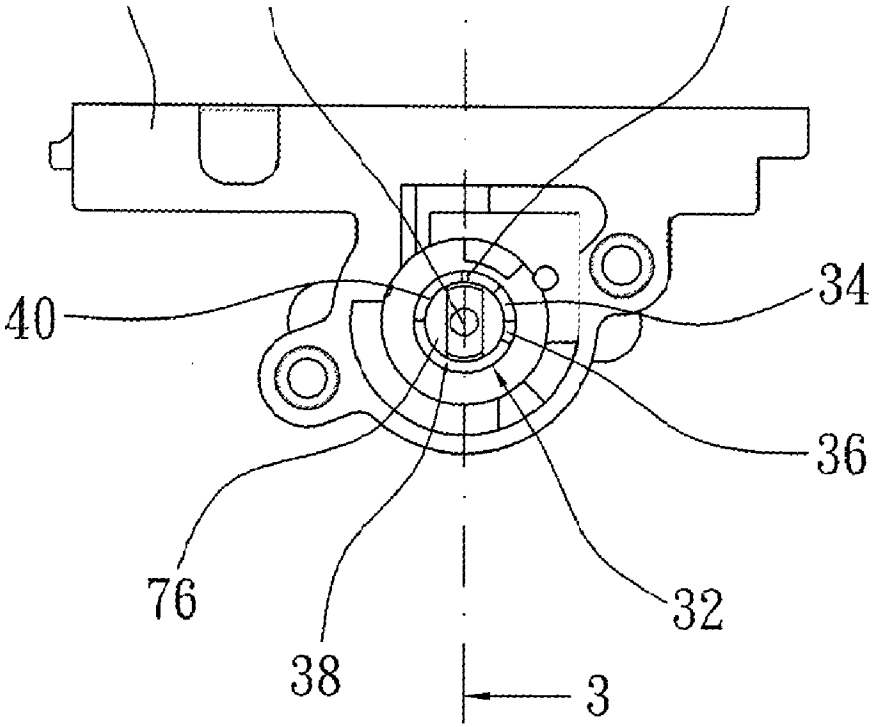
FIG. 2 is a perspective view of the cover and drive component of the first preferred embodiment of the present invention.

Refer to FIGS. 1 to 3, which show that the gas switch 10 comprises a switch body 12, a valve set 14, a drive component 16 and a connecting component 18 according to one example of the preferred embodiment of the present invention.

The switch body 12 consists of a base 22 and a cover 24. Inside the base 22, there is a conical valve chamber 26 with an opening at one end and a gas intake channel 28 and a gas outlet channel 30, both of which are connected through the conical valve chamber 26, while the cover 24 is placed at one side of the base 22, and at the side opposite to valve chamber 26, there is a containing hole 31 and a guide 32. And there is an inclining section 34, a first flat section 36, a declining section 38 and a second flat section 40 that reaches out around the containing hole 31. The inclining section 34 gradually approaches the valve set 14 in a inclined way, while the declining section 38 moves gradually faraway from the valve set 14 in a inclined way.

The valve set 14 can be installed rotatably inside the valve chamber 26 and includes a valve 42, a pilot valve 44, a leakage stopping component 46 and a spring 48. And the valve 42 has a conical switch body 50 and a protrusive ring 52 that projects above one end of the switch body 50, and there is a joint structure 53 between the switch body 50 and the protrusive ring 52. On the axis of the switch body 50, there is a through channel 54 divided into one part of big diameter 56 and the other part of small diameter 58, and a control port 60 is formed in the place where the part of big diameter 56 and the other part of small diameter 58 are connected. Besides, on the surface of the switch body 50, a guide slot 62 is installed to connect the gas intake channel 28 and a gas intake hole 64 is set to connect the guide slot 62 with the part of small diameter 58. The pilot valve 44 passes through the channel 54 of the switch body 50, and includes a rod section 66 and a pushing control section 68 which is placed at one end of the rod section 66 to correspond with the control port 60. The leakage stopping component 46 is equipped with an O-shaped ring and a circular gasket placed inside the joint structure 53 on the outward side of the rod section 66. The spring 48 is fixed by a clamping component 74 at the external side of the rod section 66 and leans against the gasket, so that the control section 68 can seal the control port 60 when no pushing force is applied to the pilot valve 44.

The drive component 16 is installed on the cover 24 and comprises a rotating rod 76, a guide rod 78 and a regulating block 80, and can rotate and move through the containing hole 31 of the cover 24 to reach into the interior of the protrusive ring 52 of the valve 42. On the rotating rod 76, there is an axle hole 82 combined with one end of the pilot valve 44 to form an internal thread 84, so as to allow the regulating block 80 to be movably installed inside and lean against the pilot valve 44. The guide rod 78 is a round rod fixed on the rotating rod 76 and close to the surface of the guide 32, so as to make it move on the surface of the guide 32 when the rotating rod 76 begins to revolve, thus causing the rotating rod 76 to generate axial displacement due to undulations on the surface of the guide 32. The regulating block 80 is a bolt, and there is a connecting component 86 at one end of the bolt close to the pilot valve 44. The connecting component 86 presents a roughly conical cross section in order to be connected with the valve 44 with low friction.

The connecting component 18 consists of two circular contact plates 88 and 89 and a spring 90. The two contact plates 88 and 89 surround the rotating rod 76 and the protrusive ring 52 of the valve 42, while the spring 90 is linked with the two contact plates 88 and 89 at the external side of the rotating rod 76 and protrusive ring 52, so that the valve set 14 can be rotated by the rotating rod 76 as it revolves.

In addition, the gas switch 10 also includes a digital ignition 19 commonly seen in ordinary gas switches, which is installed on the cover 24.

The gas switch 10 of the present invention has the features as follows:

When the drive component 16 is rotated, the guide rod 78 will move along the surface of the guide 32, which will further cause the rotating rod 78 to generate axial displacement as there are undulations on the surface of the guide 32. This will press the pilot valve 44 and change the space between the control section 68 and the control port 60, thus altering the fire intensity smoothly.

Figure 4:
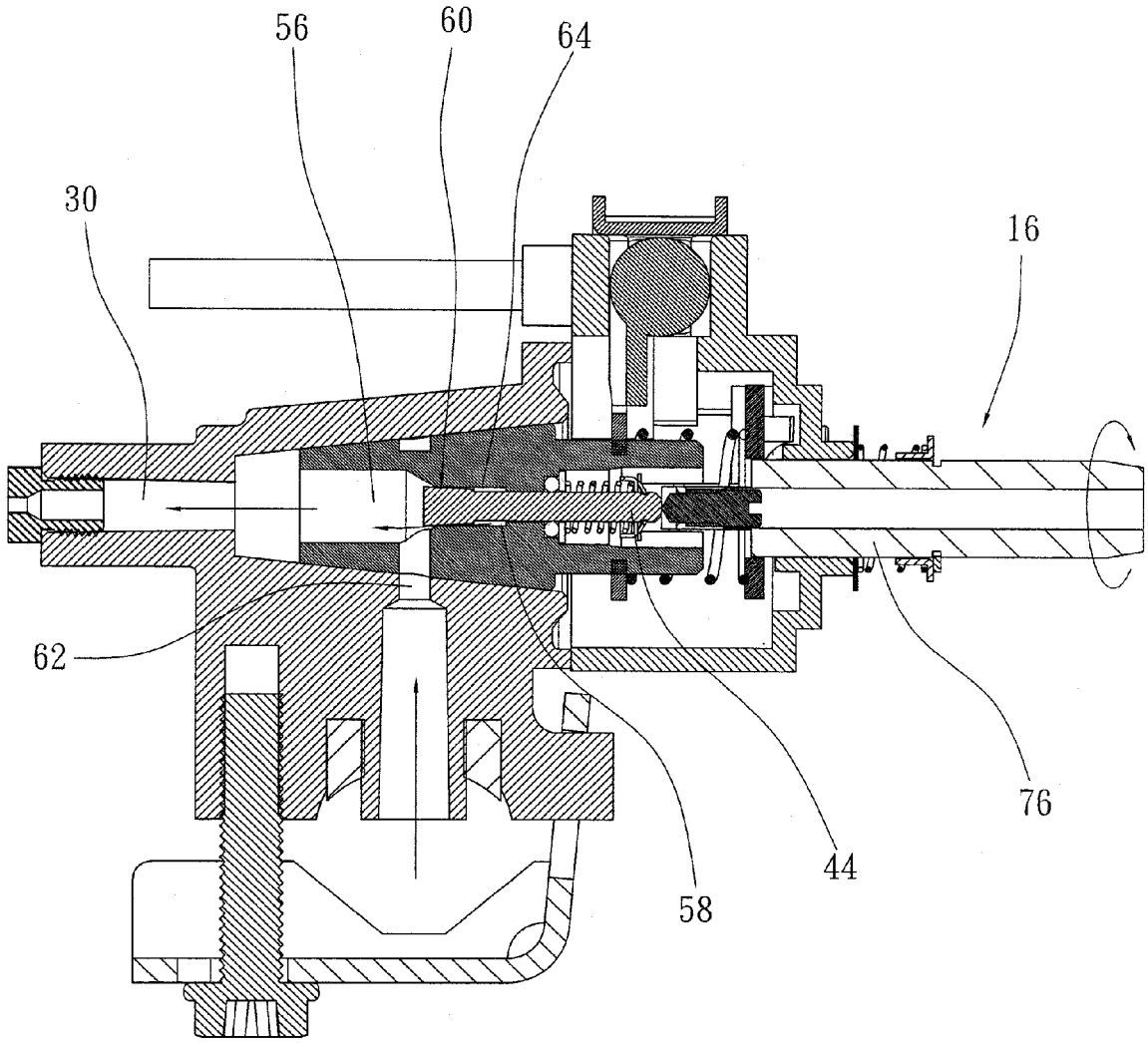
FIG. 4 shows schematically an act according to one example of the preferred embodiments of the present invention, which indicates the state in which the drive component rotates by 90 degrees.
Figure 5:
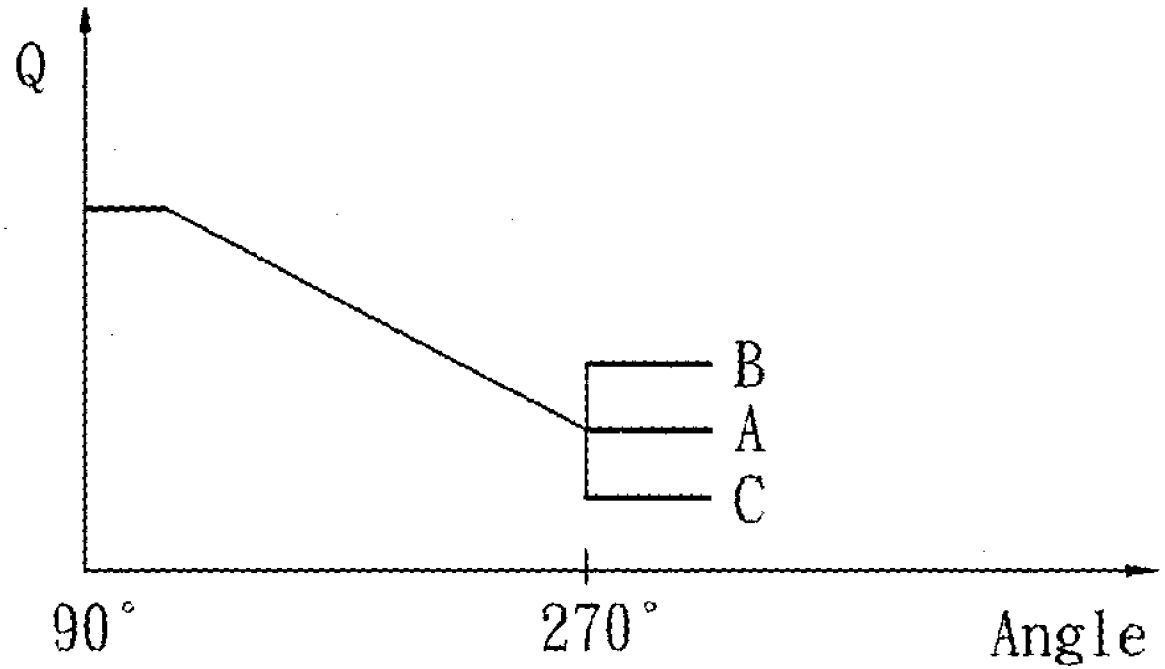
FIG. 5 is a gas flow curve diagram of the first preferred embodiment of the present invention.
Figure 6A:
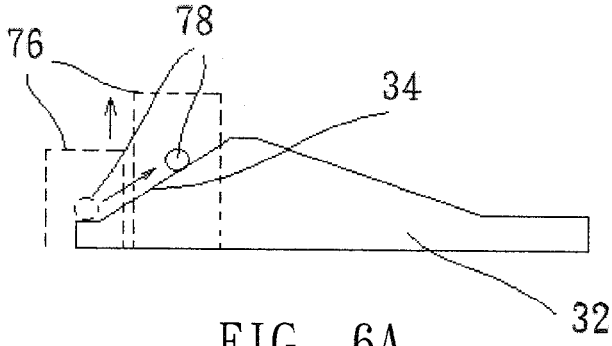
FIGS. 6A-6D show a schematic view of the first preferred embodiment of the present invention, illustrating changes in the relationship between the guide rod and the guide following rotation of the drive component.
Figure 6B:
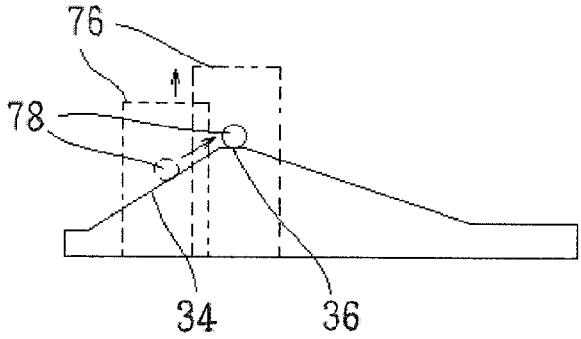

To put it in detail, as shown in FIG. 4 and the A line of FIG. 5, when the gas switch 10 performs ignition actions (generally rotate the rotating shaft by 90 degrees), the drive component 16 will be rotated, pressing the guide rod 78 to move to the first flat section 36 along the inclining section 34. So the drive component 16 will move towards and push the pilot valve 44, causing the control section 68 not to seal the control port 60 any more. As a result, gas will be discharged through the guide slot 62 and gas intake hole 64 into the part of small diameter 58, and further released out of the gas outlet channel 30 through the part of big diameter 56 for burning, as shown in FIG. 4. At this moment, the space between the control section 68 and the control port 60 reaches its maximum, hence the gas flows will reach its maximum and the fire intensity will be the highest, as shown in FIGS. 6A and 6B.

Figure 6C:
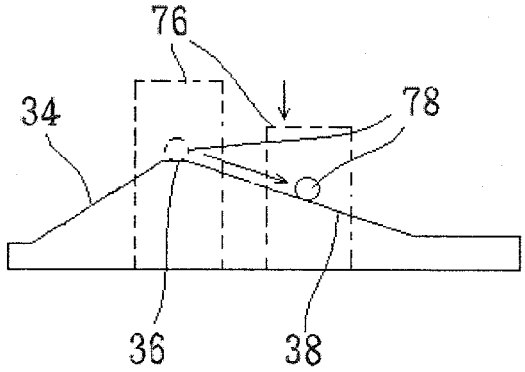
Figure 6D:
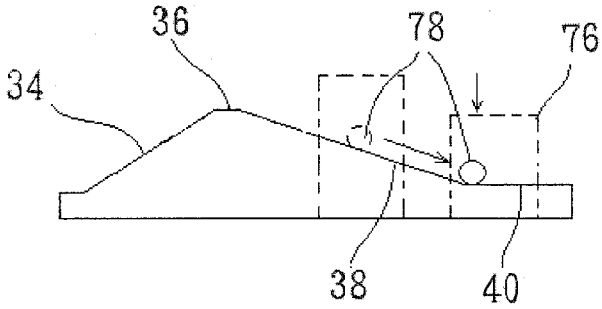

Yet as the drive component 16 continues to be rotated by more than 90 degrees, the guide rod 78 will pass over the first flat section 36 and slide into the declining section 38, as shown in FIG. 6C. In such cases, the drive component 16 will gradually move outwards due to effect of tensile force of the spring 90 in the connecting component 18, causing the pilot valve 44 to move outwards, too, due to effect of tensile force of the spring 48. This will lead to reduced space between the control section 68 and the control port 60, as a result, the gas flows will gradually reduce and the fire intensity will grow weaker. When the drive component 16 is rotated by 270 degrees, the guide rod 78 will slide onto the second flat section 40 at the end of the declining section 38, and the fire intensity will be kept at the lowest level, as shown in FIG. 6D.

Secondly, when the gas switch 10 is kept in the position of ultimate fire intensity (lowest fire intensity), the fire intensity cannot be changed or adjusted finely, because the space between the control section 68 and the control port 60 will not change any more. At this point, tools may be used to rotate the regulating block 80 so as to make it protrude or retract slightly, and then the pilot valve 44 will move backwards or forwards slightly due to effect of the pushing force from the regulating block 80. In this way, the space between the control section 68 and the control port 60 can be enlarged or shortened slightly to increase or reduce gas flows, thus making the fire intensity become stronger or weaker and eventually achieving fine adjustment of fire intensity, as shown in the B and C lines in FIG. 6.

Figure 7:
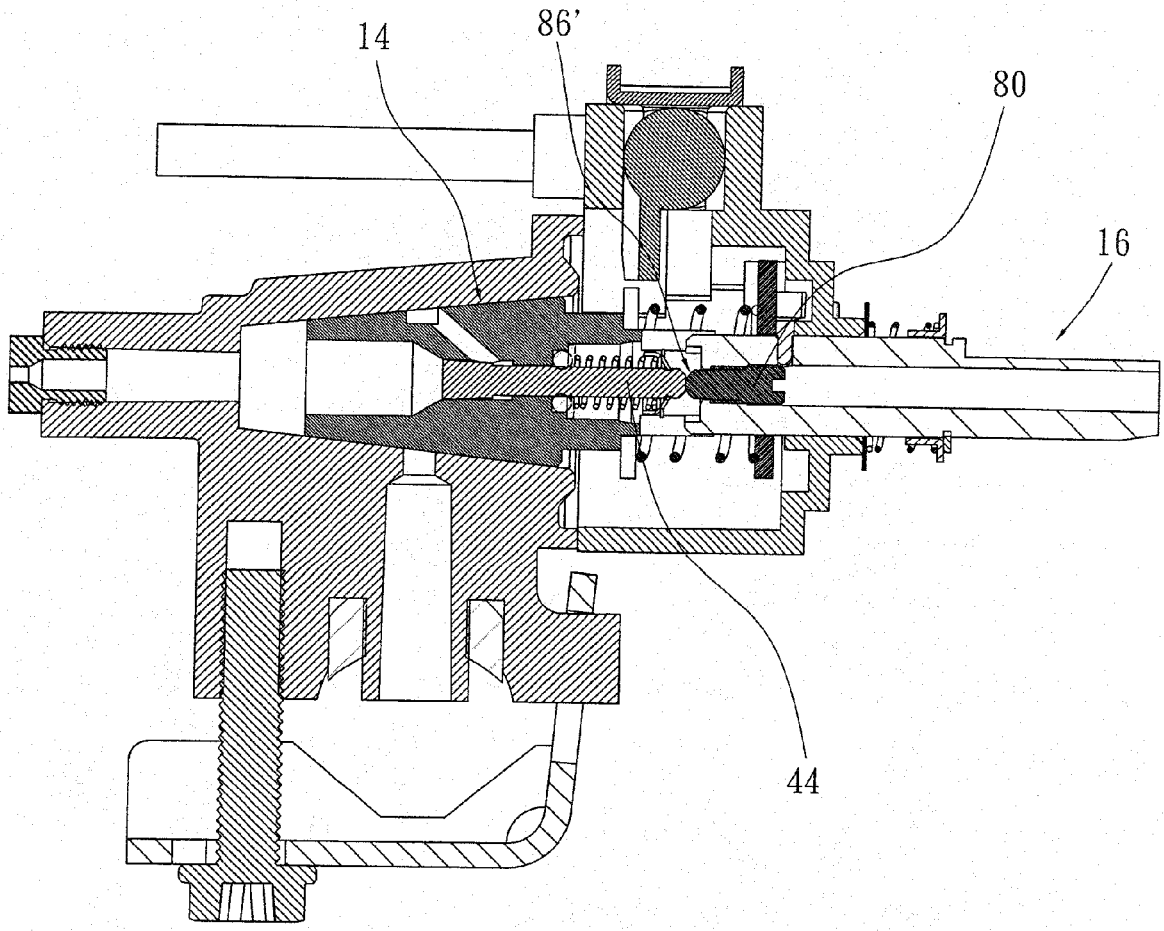
FIG. 7 is a schematic view of a second preferred embodiment of the present invention.

As shown in FIG. 7, it may also be decided in the present invention that the cross section of the connecting component 86 of the regulating block 80 is roughly like a curve, in order to keep it also in the state of low-friction contact with the pilot valve 44. This will prevent the cases where the regulating block 80 drives the pilot valve 44 to rotate as the drive component 16 rotates the valve set 14 and ensure that the structure works normally.

It can be seen from the above descriptions that the gas switch described in the present invention relies on the synergy of the guide rod and the guide to make the drive component and the pilot valve move axially and very smoothly, and further cause linear changes in the process of adjusting firepower in different intensity, thus achieving good results in fine adjustment of fire intensity. Besides, the valve set is rotated because of the effect of the driving force from the drive component, not because of that from the guide rod; therefore the guide rod is not liable to wear and tear, thus securing smooth and linear change in the process of fire intensity adjustment. Moreover, the regulating block can achieve the effect of adjusting the final fire intensity of the gas switch.

What is claimed is:

1. A gas switch capable of adjusting fire intensity finely, comprising: A switch body including a base and a cover, in the base, there is a conical valve chamber with an opening at one end and a gas intake hole as well as a gas outlet hole connected through the valve chamber, while the cover is placed at the side opposite to the valve chamber of the base, and a guide is installed inside the cover; A valve set, which is installed and rotates inside the valve chamber and includes a valve, on the axis of the valve, there is a through channel, and on the surface of it, there are a guide slot, a gas intake hole and a control port connected with the channel, and the control port is installed inside the channel; a pilot valve that can move elastically inside the valve with one control section installed at one end of it, which always seals the control port when the pilot valve is not pushed; A drive component installed on the cover, containing a rotating rod that rotates round and moves along the same shaft of the valve set, a guide rod installed on the rotating rod and closely linked with the surface of the guide, which is used to make the guide rod move on the surface of the guide when the rotating rod revolves and further causing the rotating rod to generate axial displacement, a regulating block which can move along the rotating rod and closely connected with the pilot valve; and A connecting component for linking the drive component with the valve set flexibly, which is used to transfer actions of the drive component to rotate the valve and relocate the pilot valve.

2. The gas switch capable of adjusting fire intensity finely as defined in claim 1, wherein a containing hole is opened on the cover and the drive component goes through the containing hole to correspond with the valve set, and the guide surrounds the containing hole in a protrusive way.

3. The gas switch capable of adjusting fire intensity finely as defined in claim 2, wherein the guide includes an inclining section, a first flat section, a declining section and a second flat section that reach out, the inclining section gradually approaches the valve set in an inclined way, while the declining section moves gradually faraway from the valve set in an inclined way.

4. The gas switch capable of adjusting fire intensity finely as defined in claim 1, wherein there is an axle hole passing through the rotating rod and the regulating block is installed inside the axle hole and close to the pilot valve.

5. The gas switch capable of adjusting fire intensity finely as defined in claim 4, wherein a connecting component is installed at one end of the pilot valve and suitable for being connected with the pilot valve with low friction.

6. The gas switch capable of adjusting fire intensity finely as defined in claim 5, wherein the cross section of the connecting component is roughly in the conical shape.

7. The gas switch capable of adjusting fire intensity finely as defined in claim 5, wherein the cross section of the connecting component is roughly like a curve.

8. The gas switch capable of adjusting fire intensity finely as defined in claim 4, wherein internal threads are installed inside the axle hole of the rotating rod at the end that is close to the pilot valve for the purpose of allowing the regulating block to screw into it movably.

9. The gas switch capable of adjusting fire intensity finely as defined in claim 1, wherein the connecting component comprises two contact plates which are installed at the opposite side of the rotating shaft and the valve, a spring which is connected between the two contact plates but at the outward side of the rotating shaft and valve, so that the valve can be rotated by the rotating shaft as it revolves.

10. The gas switch capable of adjusting fire intensity finely as defined in claim 1, wherein the guide rod is a round one.

* * * * *